US005255895A

United States Patent [19]

Jussilla

[11] Patent Number: 5,255,895

[45] Date of Patent: Oct. 26, 1993

[54] GEAR TRANSMISSION IN A LIFTING MACHINERY

[75] Inventor: Olavi Jussilla, Hyvinkaa, Finland

[73] Assignee: Kone Oy, Hyvinkaa, Finland

[21] Appl. No.: 879,532

[22] Filed: May 4, 1992

Related U.S. Application Data

[63] Continuation of Ser. No. 349,308, May 9, 1989, abandoned, which is a continuation-in-part of Ser. No. 134,405, Dec. 17, 1987, abandoned.

[30] Foreign Application Priority Data

Dec. 23, 1986 [FI] Finland ..... 865293

[51] Int. Cl.[5] ..... B66D 1/22

[52] U.S. Cl. ..... 254/344; 464/154

[58] Field of Search ..... 254/342, 344; 74/785, 74/740; 464/153, 154, 159

[56] References Cited

U.S. PATENT DOCUMENTS

| | | | |
|---|---|---|---|
| 1,513,738 | 11/1924 | Bomborn | 254/344 |
| 1,792,467 | 2/1931 | Osgood | 74/785 |
| 1,983,007 | 12/1934 | Simons | 464/154 |
| 3,244,405 | 4/1966 | Hanning | 254/344 |
| 3,313,124 | 4/1967 | Filepp | 464/154 |
| 3,874,194 | 4/1975 | Filepp et al. | 464/154 |
| 3,885,656 | 5/1975 | Michling | 254/344 |
| 4,310,146 | 1/1982 | F'Geppert | 254/342 |
| 4,458,882 | 7/1982 | Schörling | 254/344 |
| 4,565,322 | 1/1986 | Hasselmann | 254/344 |

*Primary Examiner*—Katherine Matecki

*Attorney, Agent, or Firm*—Kenyon & Kenyon

[57] ABSTRACT

A gear transmission for a lifting machine has at least a one step cylindrical gear transmission rotatably carried at least partly inside a rope drum. The cylindrical gear transmission and a planetary gear transmission are coupled to constitute a combined gear transmission at least partly located inside a cylindrical shell, with the combined transmission being located within the rope drum.

5 Claims, 4 Drawing Sheets

I - I

I - I

FIGURE 3
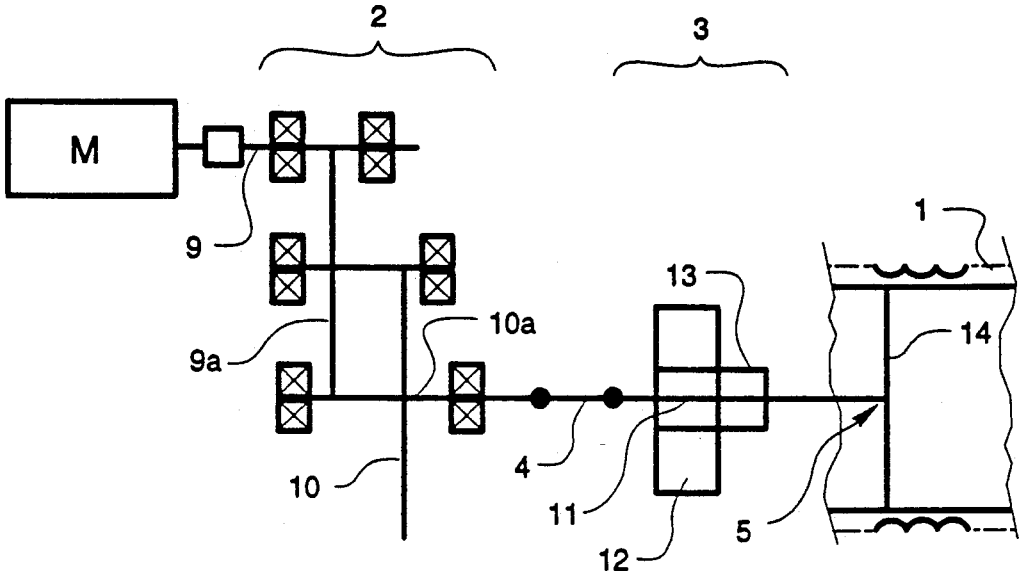
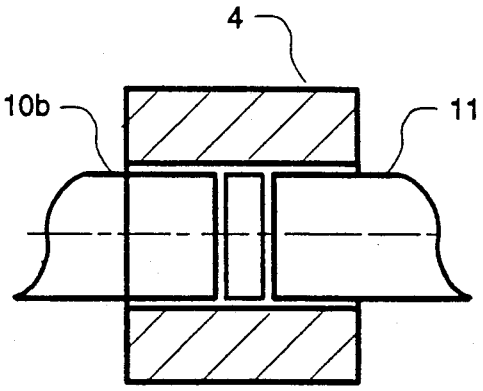
FIGURE 4A
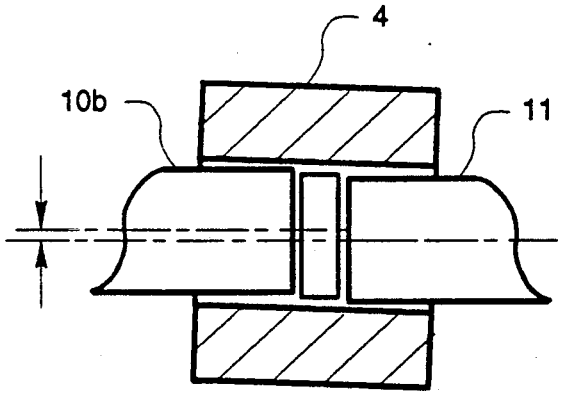
FIGURE 4B

GEAR TRANSMISSION IN A LIFTING MACHINERY

This application is a continuation, of application Ser. No. 07/349,308, filed May 9, 1989, now abandoned, which is a continuation-in-part of application Ser. No. 07/134,405, filed Dec. 17, 1987 now abandoned.

BACKGROUND OF THE INVENTION

The invention relates generally to a gear transmission for lifting machines and, more particularly, to a gear transmission comprising at least a one step cylindrical gear transmission rotatably carried at least partly inside a rope drum and a planetary gear transmission coupled to the cylindrical gear transmission.

The term "cylindrical gear transmission" as used herein refers to a gear transmission consisting of gear wheels that are cylindrical and each of which has only one contact line or point with a following or preceding gear wheel. Cylindrical gear transmissions are therefore distinguished herein from "planetary gear transmissions", which consist of planet wheels, a sun shaft and a gear rim having an internal toothing. In such planetary gear transmissions all the planet wheels are simultaneously in contact with the sun shaft and also simultaneously in contact with the gear rim. Similarly, herein "cylindrical gear" refers to a cylindrical gear wheel.

A drawback of this type of cylindrical gear transmissions, which are known from the prior art, is that they are bulky, particularly, in the case of high torque transmissions. Another disadvantage of known cylindrical gear transmissions is that they are heavy when designed for high torque.

The prior art also has used planetary gear transmissions, but these are expensive in the case of low torques because of the large number of components required. At high running speeds, vibration problems and high dynamic forces occur in planetary gear transmissions. Uniform distribution of forces in the planetary gear is another difficult problem, which is accentuated especially at high speeds of rotation. A particular difficulty in planetary gear transmissions is the non-uniform load distribution resulting from the shape, centering and pitch deviation of the teeth rims.

SUMMARY OF THE INVENTION

The invention is directed to providing a novel and advantageous type of gearbox for lifting machines that avoids or reduces the above-described problems and disadvantages of the prior art.

The invention accomplishes this by providing a gear transmission for a lifting machine comprising a rope drum, at least a one step cylindrical gear transmission rotatably carried at least partly inside the rope drum, and a planetary gear transmission coupled with the cylindrical gear transmission to form a combined gear transmission, with the combined transmission being located at least partly inside the s rope drum and including toothed coupling means for coupling the planetary gear transmission to the cylindrical gear transmission and the rope drum.

The invention combines the best characteristics of two different types of transmissions—the cylindrical gear transmission, which is advantageous in the range of a low torque and high speed of rotation, and the planetary gear transmission, which is advantageous in the range of high torque. By employing a radial arrangement of the cylindrical gears, the combined gear transmission may be constructed with minimal length, and the transmission ratio may be very high. At the high-speed initial end of the transmission, the control of the running noise and vibrations is an easy task, compared with, for example, planetary gear transmissions.

Use of toothed coupling means for coupling the planetary gear transmission to the cylindrical gear transmission and to the rope drum enables the achievement of good equalization of forces in the meshing between a sun shaft and planet gears, on one hand, and a toothed rim and the planet gears on the other hand, because the toothed coupling means provides for good equalization in parallel displacement in the planetary gear transmission. The planet carrier also is displaceable in a parallel manner. Normally, angular change is employed in the equalization of forces in a planetary gear. In that case, however, the load on the teeth is higher at one end. In the transmission of the invention, the teeth are subjected to uniform load over their entire length. This significantly increases the loading capacity, as well as service life and safety. The overall efficiency of the gear transmission is enhanced.

According to the invention a cylindrical drum contains the cylindrical gear transmission and the planetary gear transmission, with the rope drum being rotatably carried on the cylindrical drum. Moreover, when, the hardness of the cylindrical drum is selected such that the drum can be used as bearing surface and as the toothed annulus of the planetary gear transmission, a very sturdy, reliably operating unit is obtained without unnecessarily complicated designs and components.

Further features, embodiments and advantages of the invention are apparent from consideration of the following detailed description, drawing figures and appended claims.

BRIEF DESCRIPTION OF THE DRAWINGS

FIG. 3 diagrammatically illustrates a combination according to the invention of a cylindrical gear transmission and a planetary gear transmission.

FIGS. 4A and 4B show diagrammatic cross-sectional views of part of the the toothed coupling between the cylindrical and planetary gear transmissions of FIG. 1 in aligned and displaced positions, respectively.

DETAILED DESCRIPTION

Figure 1:
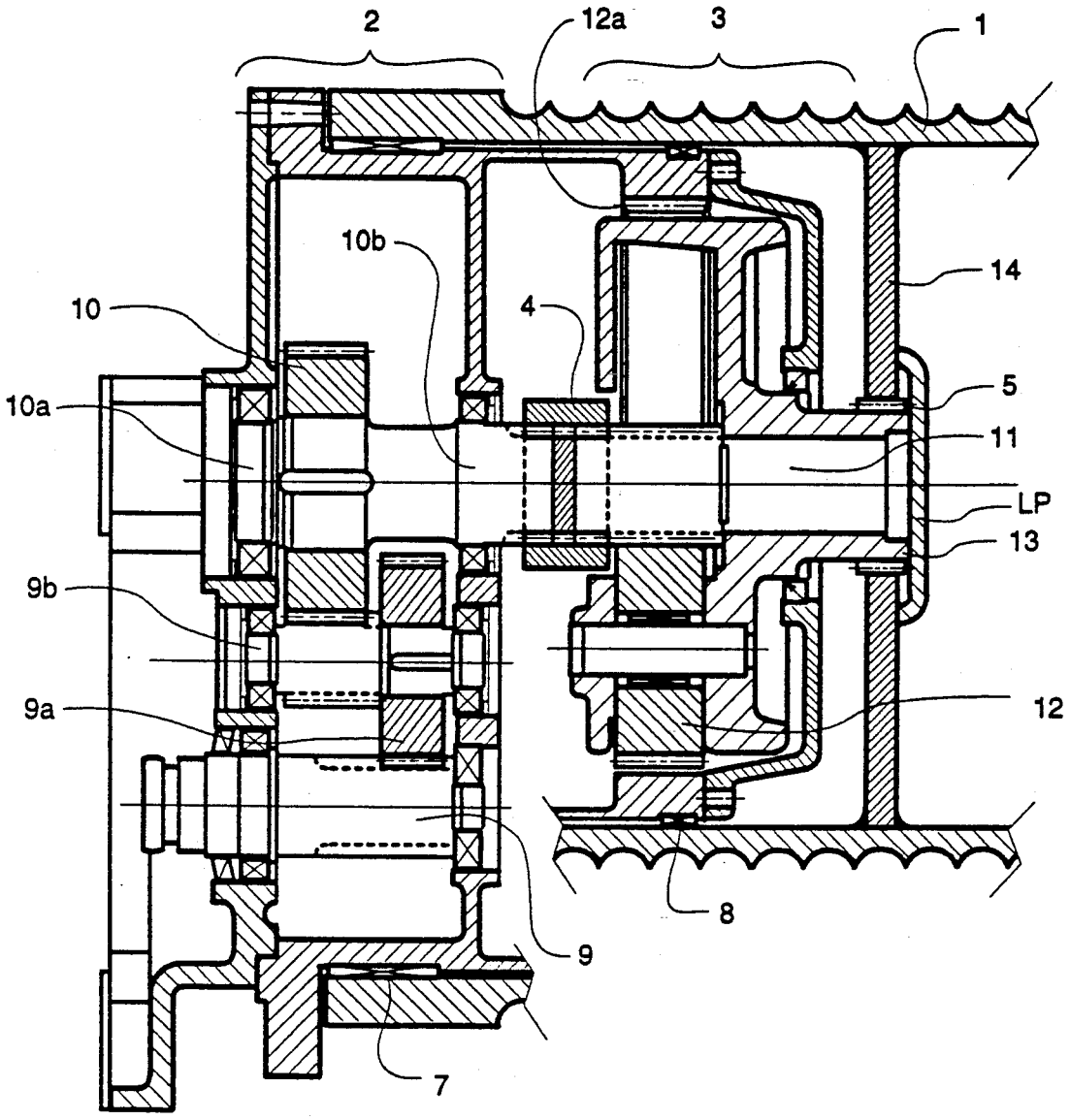
FIG. 1 illustrates a gear transmission in a lifting machine, shown in a partly expanded cross-sectional view along line I—I in FIG. 2.
Figure 2:
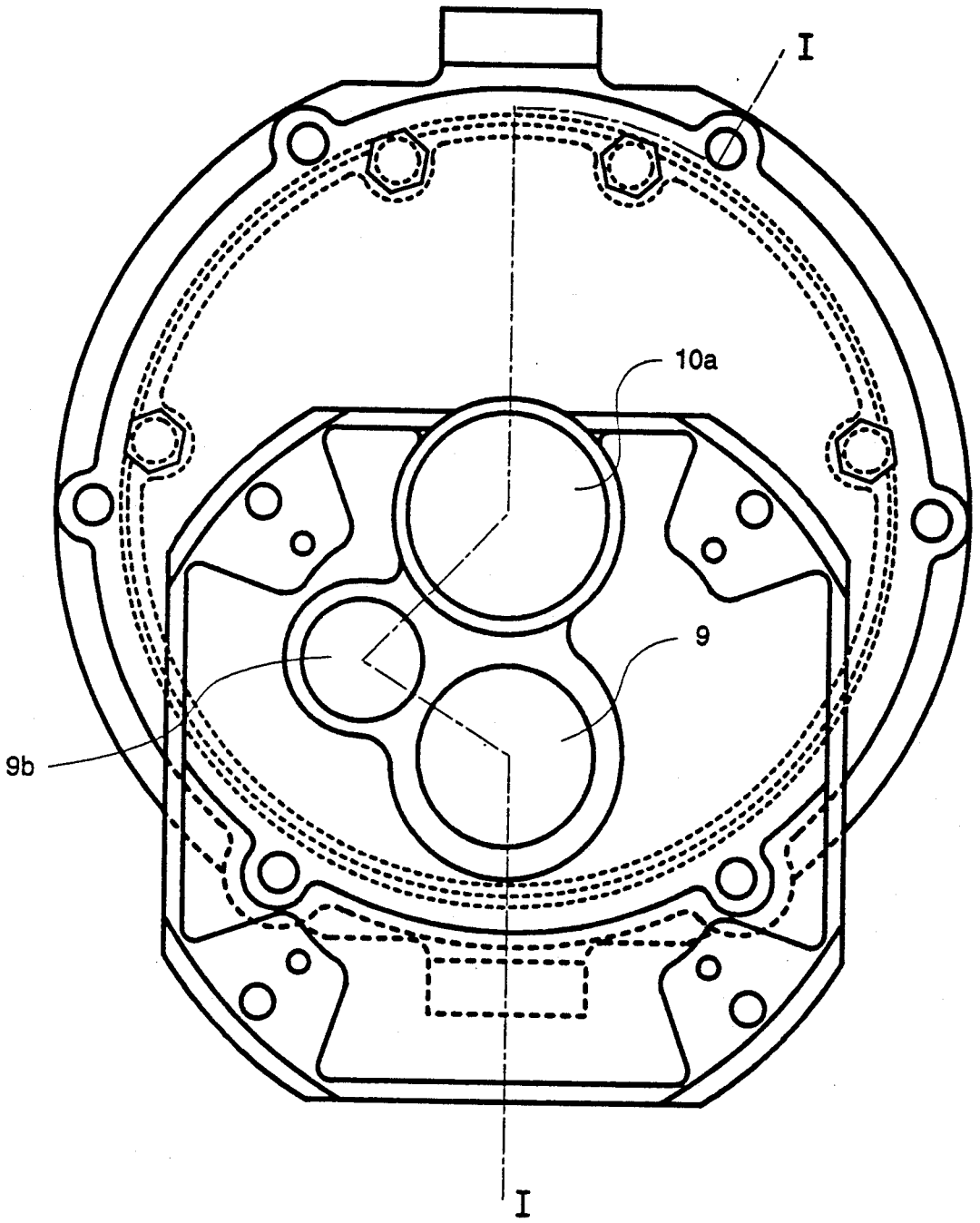
FIG. 2 shows a partial end view of the gear transmission as viewed from the left hand side of FIG. 1.

The lifting machine gear transmission shown in the drawings has a single or multiple step cylindrical gear transmission 2 rotatably carried in a rope drum 1, with the cylindrical gear transmission being coupled with the rope drum over a planetary gear transmission 3 located in the rope drum. The planetary gear transmission 3 is coupled, by means of toothed couplings 4 and 5, with the cylindrical gear transmission 2 and the rope drum 1, respectively.

The cylindrical gear transmission 2 and the planetary gear transmission 3 are located within a cylindrical drum 6, upon which the rope drum 1 is rotatably mounted by means of needle bearings 7,8. The cylindrical drum is generally cylindrical, i.e., it need not be cylindrical over its entire length, but rather only at the locations of bearings 7 and 8.

Power is supplied to the gear transmission by a shaft 9. The bearings of the cylindrical gears are located in an intermediate disk of the drum 6 and in an end shield. The cylindrical gears are radially disposed within the gear housing such that the last cylindrical gear 10 drives the sun shaft 11 with the aid of the toothed coupling 4. The toothed coupling 4 contains a toothed sleeve capable of being rotated by the end 10*b* of the splined shaft of the cylindrical gear 10.

The toothed coupling 4 transmits torque in the same way to the splined sun shaft 11. The meshings of the shafts 10*a* and 11 and the toothed coupling 4 have been selected to be loose enough so that the toothed coupling 4 may assume an oblique position when the sun shaft 11 assumes a running position defined by the planet wheels 12, so that the best possible meshing is maintained. The radial displacement of the sun shaft 11 takes place by parallel displacement with reference to the planet wheels.

The primary shaft 9, rotated by a motor (not shown), drives the first intermediate cylindrical gear wheel 9*a* that is on the first intermediate shaft 9*b* having on the other end of the shaft a toothed part. The toothed part can be a separate gear wheel or directly formed into the shaft itself. This toothed part drives further the second intermediate cylindrical gear wheel 10 that is on the second intermediate shaft 10*a* having on the other end of the shaft a toothed part 10*b*. Sun shaft 11 is also toothed. The second intermediate shaft 10*a* is connected with its toothed end 10*b* to the sun shaft 11 by the toothed coupling 4 that has internal toothing matching with the toothings of the second intermediate shaft 10*a* and the sun shaft 11.

Figure 5:
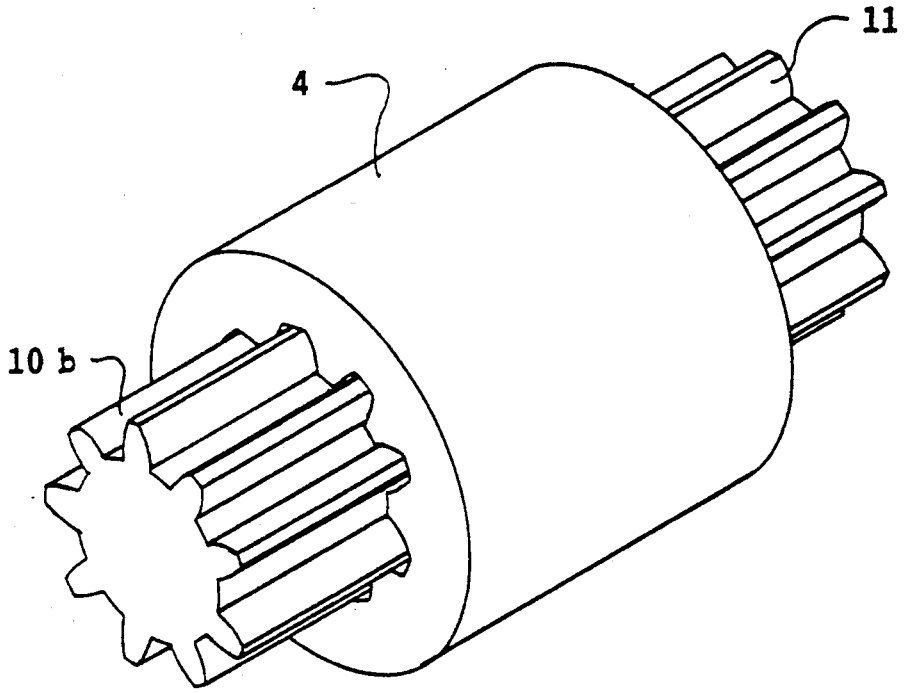
FIG. 5 illustrates a perspective view of the details shown in FIGS. 4A and 4B.

Referring to FIGS. 4A, 4B and 5, the internal toothing of the toothed coupling 4 is loose in relation to the toothing 10*b* and the toothing of the sun shaft 11. Therefore, toothed coupling 4 allows the small radial movement of the sun shaft 11. When the sun shaft moves radially (caused by minor manufacturing errors in milling the toothings of the planetary gear wheels), toothed coupling 4 turns slightly to an inclined position due to the loose fit.

Small manufacturing errors in milling the toothings of the planetary gear wheels 12, gear rim 12*a* and the sun shaft toothing require that the whole planetary gear with the sun shaft 11 should be capable of moving radially. This movement is in reality very small. If the sun shaft could not move radially, tooth contact would be overloaded because of the extra stress or tension in the toothings.

Externally toothed coupling 5 (that resembles a cylindrical gear wheel) is also loose in relation to the toothing of the intermediate disk 14 that drives the torque to the drum 1. Toothed coupling 5 can be a solid part of the planet carrier 13. The function of the toothed coupling 5 is exactly the same as the function of the toothed coupling 4.

The gear transmissions are locked axially. FIG. 1 shows the locking plate LP in the far right end of the gear box. The locking plate is welded or otherwise fixed to the toothed coupling 5 so that it presses the intermediate disk 14 with its peripheral edge. As well, the opposite end of the gear box is fixed.

As a result of the integrated design of the gear transmission, the need for radial displacement is minimal, and therefore, the tooth shape may be a standard evolvent tooth. The sun shaft 11 drives the planetary gear transmission 12. From the planet carrier 13, the torque is transferred with the aid of the toothed coupling 5 over the intermediate disk 14 to the rope drum 1. The toothed coupling 5 operates according to the same principle as the toothed coupling 4. The only difference is that the internal toothing is provided on the planet carrier 13 and on the intermediate disk 14 of the drum. The torque is transmitted by the toothed coupling 5, which may assume an oblique position. This design guarantees that the best possible meshing is obtained between the planet wheels 12 and the toothed annulus. As will be obvious from the foregoing, in this kind of combination very few components are required, and as a consequence, the gear transmission is advantageous both in production and maintenance costs. Also, its positioning in operation is good because the number of junctures giving rise to alignment errors has been minimized.

What is claimed is:

1. A gear transmission for a lifting machine comprising:

a rope drum;

a combined gear transmission comprising a cylindrical gear transmission driven by a motor, said cylindrical gear transmission having at least a one step arrangement and an output splined shaft, and a planetary gear transmission having an input splined sun shaft and a planet carrier;

an intermediate disk, fixed transversely inside said rope drum, having a central internally toothed circular opening; and a generally cylindrical drum, rotatably carrying said rope drum, containing at least partly said combined transmission, said cylindrical gear transmission being journalled on a support means of said cylindrical drum and said planetary gear transmission rotatably coupling with said intermediate disk, said combined transmission including toothed coupling means comprising:

a) a cylindrical internally toothed sleeve loosely coupling within one end said output splined shaft; and within another end, said input splined sun shaft for driving said planetary gear transmission;

so that said internally toothed sleeve is able to assume an inclined position relative to said shafts during rotation thereof, when said sun shaft effects radial displacement; and b) a cylindrical toothed end of said planet carrier, loosely coupled with the internal toothing of said intermediate disk.

2. A gear transmission for a lifting machine comprising:

a rope drum;

a cylindrical gear transmission, said cylindrical gear transmission having at least a one step arrangement;

a planetary gear transmission coupled with said cylindrical gear transmission to form a combined gear transmission, said combined transmission being located at least partly inside said rope drum;

an output splined shaft of the cylindrical gear transmission;

an input splined sun shaft of the planetary gear transmission;

coupling means for compensating for the vibrations in the planetary gear transmission at its ends, said coupling means comprising a toothed sleeve, said output splined shaft having one end loosely fitted within one end of said toothed sleeve and said input sun shaft having one end loosely fitted within another end of said toothed sleeve, so that the toothed sleeve is able to assume an inclined position relative to the shafts during rotation thereof.

3. A gear transmission for a lifting machine comprising:

a) a rope drum;

b) a partially cylindrical drum, rotatably carrying said rope drum;

c) a cylindrical gear transmission journalled at least partly inside said cylindrical drum, said cylindrical gear transmission having at least a one step arrangement;

d) an intermediate disk, fixed transversely inside said rope drum and having a central internally toothed circular opening;

e) a planetary gear transmission having a planet carrier;

f) a first toothed coupling means for coupling said planetary gear transmission to said cylindrical gear transmission; and g) a second toothed coupling means comprising a cylindrical toothed end of said planet carrier in loose mesh with the toothing of said circular opening of said intermediate disk, enabling said planetary transmission to effect radial displacements during rotation thereof.

4. A gear transmission according to claim 3, further comprising a locking plate attached to said cylindrical toothed end of said planet carrier, axially pressing against said intermediate disk for restraining axial displacement therebetween.

5. A gear transmission according to claim 3, wherein said second toothed coupling comprises an intermediary gear ring, coupling said toothed end of said planet carrier to the toothing of said circular opening of said intermediate disk.

* * * * *